United States Patent [19]

Goto et al.

[11] Patent Number: 4,660,505

[45] Date of Patent: Apr. 28, 1987

[54] DEVELOPING APPARATUS

[75] Inventors: Ryuji Goto; Hiromi Kashiwagi, both of Fukaya; Keitaro Yamashita, Kamisato all of Japan

[73] Assignee: Hitachi Metals, Ltd., Tokyo, Japan

[21] Appl. No.: 812,983

[22] Filed: Dec. 24, 1985

[30] Foreign Application Priority Data

Dec. 25, 1984 [JP] Japan ..... 59-278497

[51] Int. Cl.[4] ..... B05C 11/00

[52] U.S. Cl. ..... 118/689; 118/658

[58] Field of Search ..... 118/658, 689

[56] References Cited

U.S. PATENT DOCUMENTS 4,423,948 1/1984 Kimura ..... 118/689 X

FOREIGN PATENT DOCUMENTS 54-76165 6/1975 Japan .
53-126944 11/1978 Japan .
58-145622 8/1983 Japan .
58-202456 11/1983 Japan .
59-164575 9/1984 Japan .

*Primary Examiner*—Bernard D. Pianalto
*Attorney, Agent, or Firm*—Finnegan, Henderson Farabow, Garrett & Dunner

[57] ABSTRACT

An apparatus for developing electrostatic latent images with a two-component developer consisting of carrier and toner, comprising (a) a developer container, (b) a magnetic roll provided in the container, comprising a permanent magnet and a non-magnetic sleeve, (c) a hopper mounted on the container for replenishing toner to the container, (d) a roller provided in the container near its wall on the opposite side to the magnetic roll for mixing the developer with the toner replenished from the hopper and stirring them, (e) a device having a detection surface for detecting the concentration of toner in the developer. The detection device is mounted on the wall of the container such that the detection surface is located near the mixing roller to ensure the developer to flow smoothly and stably between the mixing roller and the detection surface.

6 Claims, 8 Drawing Figures

| | TONER CONCENTRATION | DIFFERENTIAL OUTPUT | PHASE DETECTION OUTPUT |
|---|---|---|---|
| (a) | SAME AS REFERENCE LEVEL | 0 | 0 |
| (b) | BE LOW REFERENCE LEVEL | 0 | 0 |
| (c) | ABOVE REFERENCE LEVEL | 0 | 0 |

DEVELOPING APPARATUS

BACKGROUND OF THE INVENTION

The present invention relates to an apparatus for developing electrostatic latent images carried on a photosensitive surface by a magnetic brush method.

In electrostatic latent image developing apparatuses in photocopiers, electrostatic recording apparatuses and the like, electrostatic latent images are formed on an image-carrying surface made from selenium or zinc oxide photosensitive materials, organo-photoconductive materials, etc., developed with magnetic developers by way of a magnetic brush method, and fixed on papers, or transferred to transfer sheets and then fixed.

As magnetic developers for the magnetic brush method, two-component developers consisting of ferromagnetic carriers and toners are widely used. The magnetic carriers are iron particles, ferrite particles, nickel particles, etc. which may be coated with organic polymers. The toners are fine resin particles containing coloring pigments or dyes dispersed therein. The carrier and toner are selected so that they are charged in opposite polarities by friction when mixed and stirred.

When the development of the electrostatic latent images is carried out using a two-component developer, the concentration of toner in the developer decreases as the development proceeds, because the toner is consumed by the development.

Thus, when the two-component developer is used, a developing apparatus should have a system comprising a means for detecting the concentration of toner and means for replenishing toner in response to a signal provided by the detecting means, thereby maintaining the toner concentration of the developer at a predetermined level (3–10%).

The detection of the toner concentration is generally performed by utilizing the phenomenon that the permeability of the developer varies depending on the toner concentration. For instance, a Hall element was proposed which is placed in a magnetic field of permanent magnet members to detect magnetic fluxes leaked from the developer (see Japanese Patent Laid-Open No. 51-117047). The Hall element shows high detection accuracy, but it is widely affected by temperature variations so that its output is not always reliable.

Thus, what is more widely utilized is a detection device comprising a coil placed in contact with the developer such that a part of its magnetic circuit is constituted by the developer, whereby the concentration of toner is detected as the variation of inductance of the detection coil (see, for instance, Japanese Patent Laid-Open Nos. 53-49437 and 54-159233).

In general, a developing apparatus for a two-component developer is equipped with a scrape adjacent to a non-magnetic sleeve of a magnetic roll to remove the developer remaining on the surface of the non-magnetic sleeve after developing operations so that the developer once used may be mixed with newly added toner. Proposals have been made to provide a guide member adjacent to the scraper to collect part of the developer falling from the nonmagnetic sleeve as a sample, and to carry out the detection of the toner concentration without being affected by the magnetic field of a permanent magnet in the magnetic roll (see, for instance, Japanese Patent Laid-Open Nos. 53-126944 and 54-76165). Further proposals have been made to provide detection coil above a scraper so that the detection coil can detect the toner concentration of the developer flowing on the scraper (see, for instance, Japanese Patent Laid-Open No. 59-164575). However, in this case, the detection surface of the coil is not in stable contact with the developer, resulting in variations of a developer density. Eventually, this fails to provide an accurate value of a toner concentration.

OBJECT AND SUMMARY OF THE INVENTION

An object of the present invention is, therefore, to provide a developing apparatus capable of detecting a toner concentration with reliable accuracy.

An developing apparatus according to the present invention comprises (a) a developer container; (b) a magnetic roll provided in the container comprising a permanent magnet and a non-magnetic sleeve; (c) a hopper mounted on the container for replenishing toner to the container; (d) a roller provided in the container near its wall on the opposite side to the magnetic roll for mixing the developer with the toner replenished from the hopper and stirring them; and (e) a device having a detection surface for detecting the concentration of the toner in the developer, characterized in that the detection device is mounted on the wall of the container such that the detection surface is located near the mixing roller to ensure the developer to flow smoothly and stably between the mixing roller and the detection surface.

DESCRIPTION OF THE PREFERRED EMBODIMENTS

Figure 1:
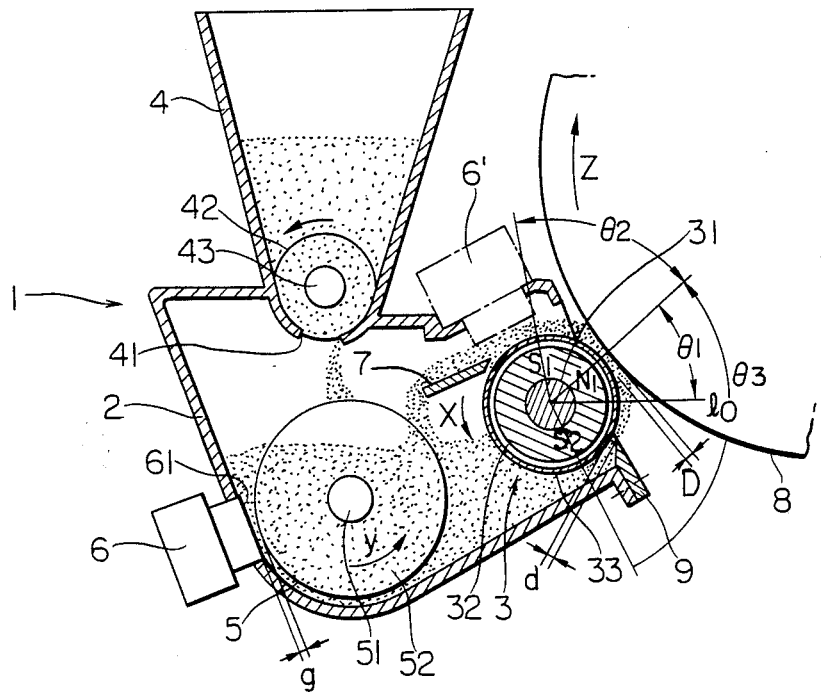
FIG. 1 is a vertical cross-sectional view of a developing apparatus according to one embodiment of the present invention.

Referring to FIG. 1, a developing apparatus according to one embodiment of the present invention is indicated by a reference numeral "1". The developing apparatus 1 is constituted by a developer container 2, a magnetic roll generally indicated by "3", a hopper 4 mounted on a top wall of the container 2 for supplying toner to the container 2, a mixing roller 5 provided in the container 2 and rotatably supported by both side walls of the container 2, and a toner concentration detection device 6.

The magnetic roll 3 is constituted by a shaft 31, a permanent magnet 32 secured to the shaft 31 and having a plurality of magnetic poles, and a non-magnetic sleeve 33. In this embodiment, the permanent magnet 32 is stationary while the non-magnetic sleeve 33 is rotating as shown by arrow X. The permanent magnet 32 has three poles; one north pole $N_1$ and two south poles $S_1$ and $S_2$. A scraper 7 is located such that its edge is extremely close to the surface of the non-magnetic sleeve 33 so that it scrapes off the developer from the non-magnetic sleeve 33.

Figure 2:
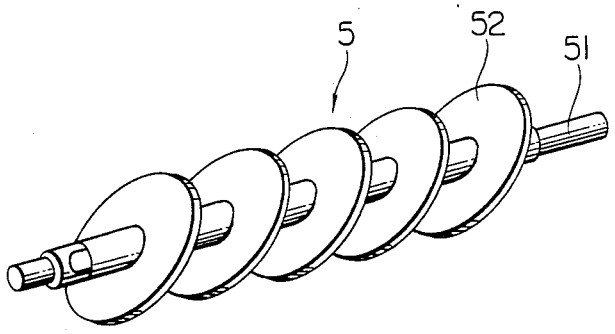
FIG. 2 is a perspective view of the mixing roller.

FIG. 2 shows one example of the mixing roller 5. It consists of a shaft 51 and a plurality of blades 52, each of which is in an oval form and slantingly secured to the shaft 51. The mixing roller 5 is rotatably supported by the side walls of the developer container 2, and is rotated by a driving mechanism (not shown) engaging one end of the shaft 51. The mixing roller 5 is preferably located beneath the hopper 4 so that the toner supplied from the hopper 4 is immediately mixed with the developer existing in the container 2.

The hopper 4 has an opening 41 at a bottom thereof, and is equipped with a roller member 42 made of a soft, porous material secured to a shaft 43 which is rotated by a driving mechanism (not shown). The roller member 42 is located at such a position that it closes the opening 41 completely with its cylindrical surface. Thus, when it is stationary, no toner falls into the container 2 from the hopper 4. However, since the roller member 42 is made from a soft, porous material such as a urethane foam, the toner is conveyed by the roller member 42, when the shaft 43 is rotated, through a gap between a hopper inner wall and the outer surface of the roller member 42 and falls into the container 2. Accordingly, the replenishment of toner can be controlled by controlling the rotation of the roller member 42.

The developing apparatus 1 is mounted in an electrostatic copying machine or any other suitable machine such that the magnetic roll 3 is located close to a drum 8 carrying electrostatic latent images with a small gap D. The drum 8 has a surface layer made from a photosensitive material. In FIG. 1, the $N_1$ pole is close to the photosensitive drum 8, so it serves as a developing magnetic pole. On the other hand, the two south poles $S_1$ and $S_2$ serve as developer-carrying magnetic poles.

Incidentally, a doctor blade 9 is mounted on a bottom wall of the container 2 adjacent to the magnetic roll 3 with such a small gap "d" as to regulate the height of a developer on the non-magnetic sleeve 33 at gap D.

A detection device 6 is mounted on a side wall of the developer container 2 near the mixing roller 5. It has a detection surface 61 facing the mixing roller 5, providing a small gap "g" therebetween. Since the blades 52 of the mixing roller 5 are rotating continuously to mix and stir the developer, the developer flows incessantly on the detection surface 61, thus ensuring the accurate measurement of the toner concentration.

Figures 3, 4:
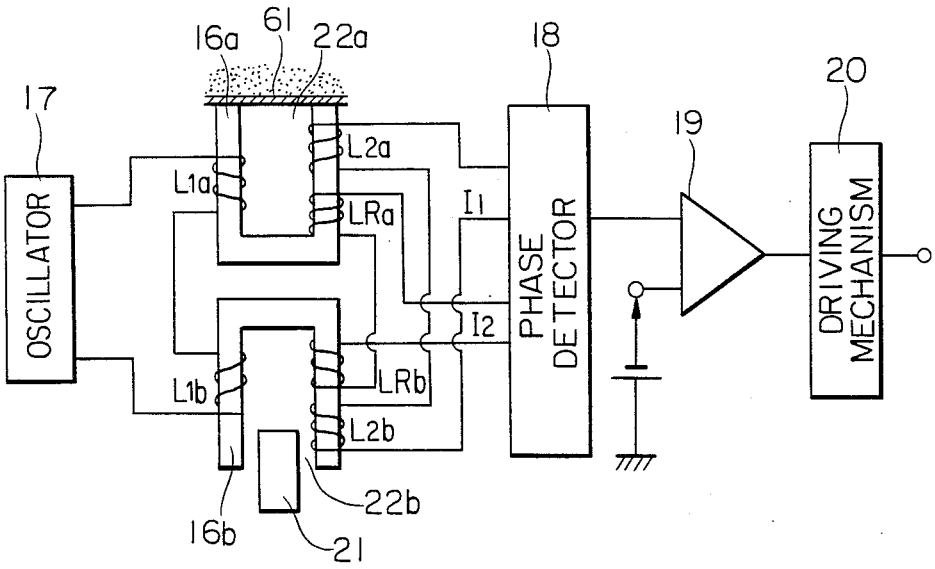
FIG. 3 is a schematic view of a circuit of the toner concentration detection device.
FIG. 4 is a graph showing the relationships between toner concentrations and phase detector outputs.

The detection device 6 per se may have a structure known by Japanese Patent Laid-Open No. 59-99462, which is shown in FIG. 3. It contains a pair of U-shaped magnetic cores **16*a*, 16*b*. Core 16*a* is provided with the detection surface 61 facing a developer which serves to close a gap 22*a* of a magnetic circuit of the core 16*a*, and core 16*b* having a gap 22*b* for receiving a magnetic member 21 to adjust the coupling coefficient of a magnetic circuit through the core 16*b* and the magnetic member 21. The core 16*a* is provided with a primary coil $L_{1a}$, and two secondary coils $L_{2a}$ and $L_{Ra}$. On the other hand, the core 16*b* is provided with a primary coil $L_{1b}$ and two secondary coils $L_{2b}$ and $L_{Rb}$. Primary coils $L_{1a}$ and $L_{1b}$ are connected in series, and also connected to an oscillator 17. Secondary coils $L_{2a}$ and $L_{2b}$ are connected in series with their polarities opposite to each other, and also connected to a phase detector 18 to supply a differential output $I_1$, thereto. Secondary coils $L_{Ra}$ and $L_{Rb}$ are connected in series with their polarities aligned in the same direction as that of an input signal from the oscillator 17, and also connected to the phase detector 18 to supply a reference signal $I_2$ thereto. The output of the phase detector 18 is supplied to a comparator 19 which compares it with a reference voltage. The output of the comparator 19 is supplied to a driving mechanism 20 which rotates the roller member 42 to replenish a toner into the container 2**.

The operation of the developing apparatus according to the present invention will be described below.

Referring to FIG. 1 again, the non-magnetic sleeve 33 is rotated in the direction shown by arrow X while the permanent magnet 32 is stationary. The photosensitive drum 8 is also rotated in the direction shown by arrow Z. The developer attracted on the surface of the non-magnetic sleeve 33 passes through a gap "d" between the non-magnetic sleeve 33 and the doctor blade 9 and moves into gap D in the form of a magnetic brush on the rotating non-magnetic sleeve 33. At gap D, the toner is attracted onto the photosensitive drum 8 according to the patterns of electrostatic latent images carried thereon. The remaining developer is carried by magnetic poles $S_1$ and then removed from the non-magnetic sleeve 33 by the scraper 7 to return to the container 2. Because the mixing roller 5 is rotating in the direction shown by arrow Y in the container 2, the developer returning from the non-magnetic sleeve 33 after development is uniformly mixed with the developer existing in the container 2. Because the detection surface 61 is provided on the side wall of the container 2 near the mixing roller 5 with a small gap "g", a smooth and stable flow of developer is maintained on the detection surface 61.

Referring to FIG. 3, phase detector 18 is adjusted so as to provide a "zero" level output when the toner concentration is on the predetermined level. When the toner level is lowered, the permeability of the developer increases because the toner is non-magnetic and the carrier is magnetic. With the increased permeability, the coupling coefficient of a magnetic circuit through the core **16*a* and the developer increases. Because the outputs of secondary coils $L_{2a}$ and $L_{2b}$ are opposite in phase, the output $I_1$ has the same polarity as that of the reference signal, assuming that coil $L_{2a}$ provides an output having the same polarity as that of the reference signal. The output of the phase detector is compared with a reference level at the comparator, supplying a signal to the driving mechanism. According to the signal, the roller member 42 is rotated to supply a new toner into the container 2. After the newly added toner is mixed with the developer, the toner concentration increases to the predetermined level, and the rotation of the roller member 42 is halted. If the toner concentration exceeds the predetermined level, the differential output $I_1$ has a different polarity from that of the reference signal so that the phase detector 18 provides an output of opposite polarity. Such behavior is shown in FIG. 4**.

As mentioned above, the output of the phase detector 18 varies depending on the permeability of the developer which in turn depends on the toner concentration. Thus, the supply of toner from the hopper 4 can be controlled by the roller member 42 to adjust the toner concentration to the predetermined level.

If the toner concentration is to be changed, the magnetic member 21 is adjusted. Particularly where the magnetic member 21 is in the form of a threaded ferrite core which is received in a cavity 22*b* of the core 16*b*, adjustment is easily conducted by turning it rightwardly or leftwardly.

Since the detection device 6 detects the toner concentration by utilizing the variations of inductance of detection coils, a detection signal may be affected by various factors, such as a magnetic field generated by the permanent magnet 32; ambient conditions such as temperatures and humidities; and variations of developer flow. However, since the detection device 6 is positioned near the mixing roller 5 with a small gap "g" far from the permanent magnet 32, the detection of the toner concentration is not substantially affected by the above-mentioned factors.

The fact that the detection is not affected by a magnetic field of the permanent magnet is significant because it makes it unnecessary to adjust precisely the position of the magnetic roll 3, the angular position of magnetic poles of the permanent magnet 32 and the like.

With respect to the ambient conditions, they do not substantially affect a smooth and stable flow of the developer between the detection surface 61 and the mixing roller 5. It is believed that the above-mentioned positional relationship of the detection surface 61 with the mixing roller 5 ensures a smooth and stable flow of developer no matter what ambient conditions.

With respect to the gap "g", if it is too wide, the developer tends to be stagnant on the detection surface 61. This results in inaccurate detection. And if it is too small, excessive friction takes place between the toner and the detection surface. Therefore, the gap "g" is preferably 5 mm or less, and more preferably 0.5 mm–3 mm.

Since a high-frequency magnetic flux of about 100–250 kHz is generated at the detection device 6, there is an alternating magnetic field near the detection surface 61. If the mixing roller 5 is conductive, eddy current flows in the mixing roller 5, generating a demagnetizing field based on the eddy current. Accordingly, unevenness of developer density appears, resulting in the variations of output valtages. Thus, the mixing roller 5 should be made from non-magnetic, insulating materials. For the same reason, the portion of the developer container 2 in the vicinity of the detection device 6 should be made from non-magnetic, insulating materials, such as plastics.

To promote the detection accuracy of the toner concentration, a smoothing circuit or integration circuit is added between the phase detector 18 and the comparator 19 (see, for instance, Japanese Patent Laid-Open No. 59-99463). Because there is a time lag between the initiation of toner supply from the hopper 4 and the uniform mixing of the newly supplied toner with the developer existing in the container 2, fluctuation is inevitable in the detected values of the toner concentration. The smoothing circuit or integration circuit can suppress such phenomenon. Such circuit is usually constituted by a capacitor (C) and a resistor (R) in series. This CR circuit should have a proper time constant $\tau = CR$ to improve the detection accuracy.

Specifically, the time constant $\tau$ should satisfy the following equation:

$$4/N \geqq \tau \geqq 1/N$$

wherein N represents how many times an outer edge of each blade of the mixing roller 5 passes near the detection surface 61 for a unit time. Referring to FIG. 2, for instance, since each blade 52 is slanting with respect to the shaft 51, the outer edge of each blade 52 passes near the detection surface 61 twice in every turn of the mixing roller 5. Thus, the density of the developer changes periodically in proportion to the number "N", generating noises in the detected values of the toner concentration. Where the time constant $\tau$ is 1/N or larger, such noises are effectively eliminated to enhance the detection accuracy. On the other hand, where it exceeds 4/N, the detection circuit has too poor response.

Incidentally, any kinds of carriers may be used for the purpose of the present invention, but ferrite carriers are preferable. Examples of ferrite carriers are described in, for instance, Japanese Patent Publication No. 56-52305 and Japanese Patent Laid-Open Nos. 58-145622 and 58-202456. Since the ferrite carriers have good flowability, a smooth and stable flow of the developer can be maintained on the detection surface.

The present invention will be described in further detail by the following Examples.

EXAMPLE 1

In FIG. 1, the photosensitive drum 8 was a Se drum having a 120-mm outer diameter rotating at a peripheral speed of 150 mm/sec, the non-magnetic sleeve 33 was a stainless steel cylinder of a 32-mm outer diameter rotating at 300 r.p.m., and the permanent magnet 32 was a Sr-ferrite magnet cylinder of a 29-mm outer diameter having three magnetic poles: an $N_1$ pole of 950 G and $S_1$ and $S_2$ poles each of 800 G (measured on the sleeve surface). The angle $\theta_1$ of the $N_1$ pole to the horizontal line was 43°, and the angles $\theta_2$ and $\theta_3$ between the $N_1$ pole and the $S_1$ and $S_2$ poles were 60° and 105°, respectively. The developer container 2 was made from an ABS resin. The mixing roller 5 was constituted by a stainless steel shaft 51 and oval blades 52 made from Delrin secured slantingly to the shaft 51. The mixing roller 5 was rotated at 160 r.p.m. (1/N was about 0.19 sec.).

The detection surface 61 was positioned with a small gap "g" of 1 mm from the mixing roller 5. The detection device 6 shown in FIG. 3 was set to provide output signals at a mean value of 2.5 V, and it was equipped with a smoothing circuit having a time constant $\tau = 0.2$ sec between the phase detector 18 and the comparator 19.

Both doctor gap "d" and development gap "D" were set at 1.0 mm. The developer used was composed of ferrite carriers of 50–150 μm in particle size (trade name KBN-100 manufactured by Hitachi Metals, Ltd.) and toners of 5–20 μm in particle size (consisting essentially of a stylene-acrylic copolymer and carbon particles).

Under each of two ambient conditions (20° C. 20% relative humidity and 20° C. 80% relative humidity), 500 copies were prepared consecutively. The toner concentration was measured after the completion of copying. Further measurements were carried out under the same conditions except for mounting the detection device 6 above the scraper 7 (shown by a position 6'). The results are shown in Table 1.

TABLE 1

| | Toner Concentration (wt. %) | | |
|---|---|---|---|
| | Set value | 20° C., 20% R.H. | 20° C., 80% R.H. |
| Position A[1] | 3.0 | 2.9 | 3.1 |

TABLE 1-continued

| | Toner Concentration (wt. %) | | |
|---|---|---|---|
| | Set value | 20° C., 20% R.H. | 20° C., 80% R.H. |
| Position B[2] | 3.0 | 2.9 | 4.0 |

Note:
[1]Position shown by 6 in FIG. 1
[2]Position shown by 6' in FIG. 1

As is evident from Table 1, the detected value of the toner concentration largely varies depending on relative humidity where the detection device is positioned at 6', but it is almost the same regardless of the variations of relative humidity where the detection device is positioned near the mixing roller 5 with a small gap as shown by 6 in FIG. 1.

EXAMPLE 2

Figure 5:
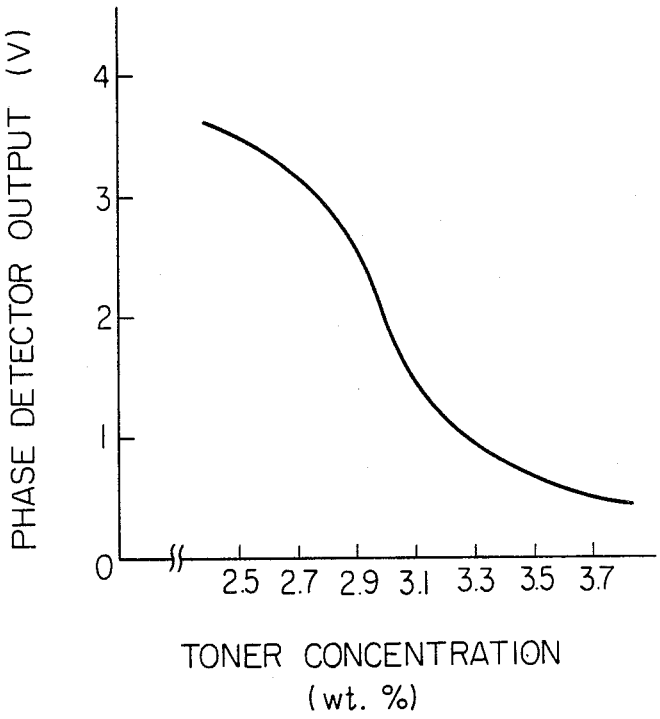
FIG. 5 is a graph showing the relationship between a toner concentration and a phase detector output.

Under the same conditions as in Example 1 and at position A, 20° C. and 20% relative humidity, measurements were carried out to provide relationships between the outputs of the phase detector and the toner concentration. The results are shown in FIG. 5.

EXAMPLE 3

Figure 6:
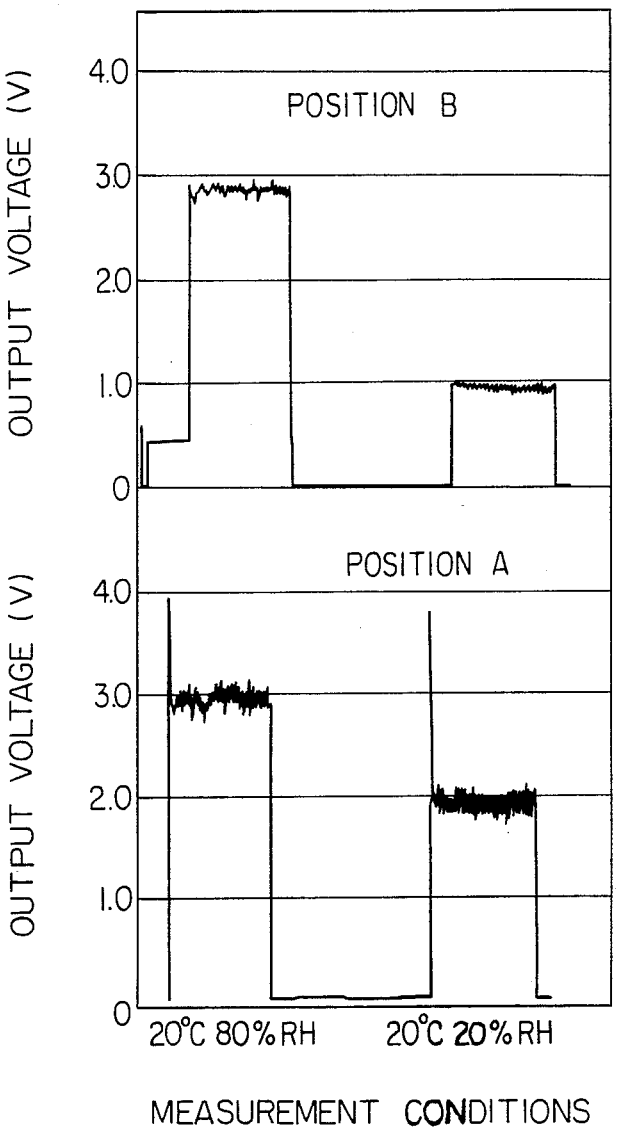
FIG. 6 is a graph showing the relationship between relative humidities and output voltages of the phase detector.

Under the same conditions as in Example 1, measurements were carried out to provide the outputs of the detection device while keeping the toner concentration at constant (3.0 wt. %). The results are shown in FIG. 6. As is evident from FIG. 6, the output voltage of the phase detector varies largely as the ambient conditions change where the detection device is positioned above the scraper 7 (position B). On the other hand, where the detection device is positioned according to the present invention (position A), the output voltage does not vary largely (within about one volt).

EXAMPLE 4

Figure 7:
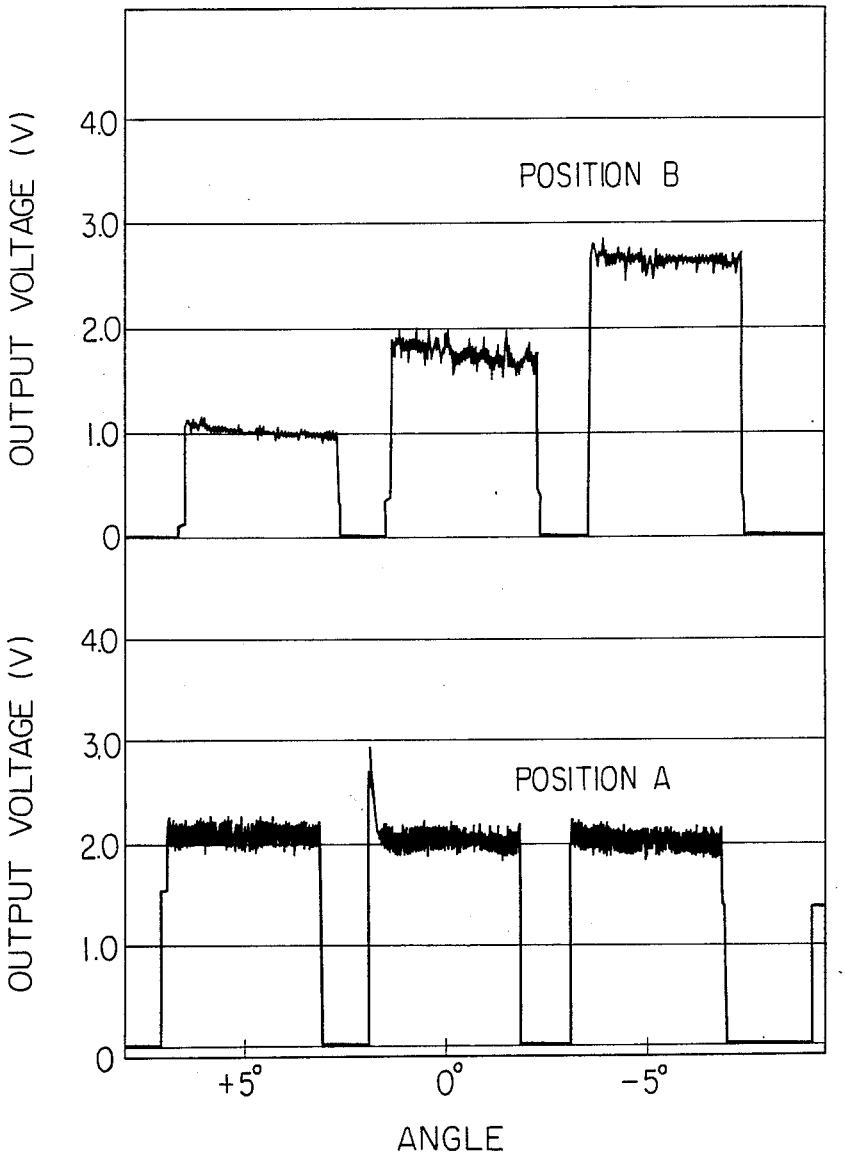
FIG. 7 is a graph showing the relationship between the circumferential positions of magnetic poles of the permanent magnet and output voltages of the phase detector.

Under the same conditions as in Example 1 (20° C., 20% relative humidity), the output voltage of the detection device was measured with magnetic poles of the permanent magnet 32 changed at various angular positions. The results are shown in FIG. 7 in which ±5° means that the permanent magnet 32 is rotated from the position shown in FIG. 1 by 5° counterclockwise and clockwise, respectively. It is observed that the output voltage of the phase detector 18 is largely affected by the positions of magnetic poles where the detection device 6 is positioned above the scraper 7 (position B). Since the detection device 6 is mounted far from the permanent magnet 32 according to the present invention (position A), the output voltage of the phase detector 18 is not substantially affected by the positional changes of the magnetic poles. This is advantageous because the position of the detection device 6 according to the present invention (position A) does not require the precise positioning of the permanent magnet 32, thus making it unnecessary to adjust the permanent magnet 32 after mounting.

EXAMPLE 5

Figure 8:
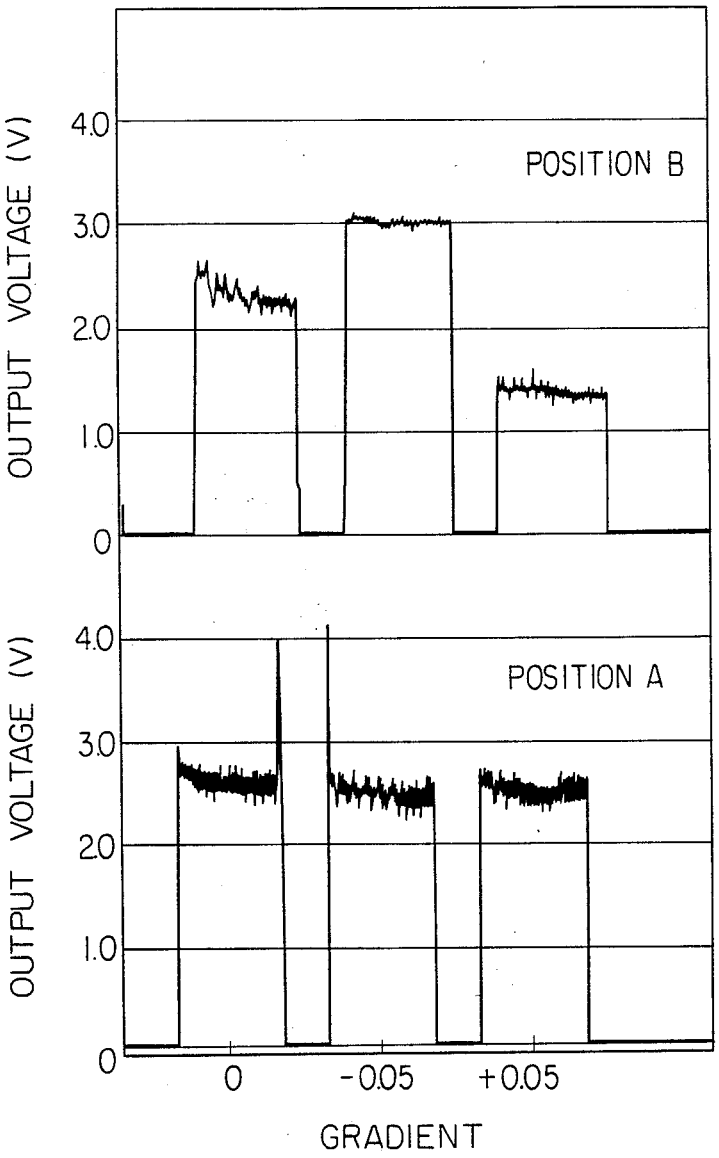
FIG. 8 is a graph showing the relationship between the inclination of the developing apparatus and output voltages of the phase detector.

Under the same conditions as in Example 1 (20° C., 20% relative humidity), the output voltage of the phase detector 18 was measured with the developing apparatus inclined at various angles. The results are shown in FIG. 8 in which the gradient ±0.05 means that the developing apparatus is inclined from the position shown in FIG. 1 by such values counterclockwise and clockwise, respectively. It is observed that the output voltage of the phase detector varies largely depending on the inclination of the developing apparatus at position B (above the scraper 7), while it is almost the same regardless of the inclination of the developing apparatus at position A (near the mixing roller 5). This is particularly advantageous because copying machines and printers are placed on various places, all of which are not necessarily horizontal.

The present invention has been explained referring to the drawings, but it should be noted that any variations and modifications are possible unless they deviate from the spirit and scope of the present invention defined in the attached claims.

What is claimed is:

1. An apparatus for developing electrostatic latent images with a two-component developer consisting of carrier and toner, comprising:

(a) a developer container having walls;

(b) a magnetic roll provided in said container, comprising a permanent magnet and a non-magnetic sleeve;

(c) a hopper mounted on said container for replenishing toner to said container;

(d) a roller made from a non-magnetic, insulating material provided in said container near the wall most distant said magnetic roll for mixing said developer with the toner replenished from said hopper and stirring them; and (e) a device having a detection surface for detecting the concentration of said toner in said developer, said detection device being mounted on the most distant wall of said container such that said detection surface is located at a distance of 5 mm or less from said mixing roller to ensure said developer to flow smoothly and stably between said mixing roller and said detection surface, said mixing roll and said detection surface also being configured to provide a constant flow of developer across said detection surface, and wherein said detection device comprises first and second magnetic cores each having primary and secondary coils, said first magnetic core facing the developer through said detection surface, said second magnetic core having a magnetic member for adjusting a coupling coefficient of a magnetic circuit thereof so that it serves as a reference core, and the difference in outputs from said two secondary coils being used to detect the toner concentration of said developer which depends on the permeability of said developer.

2. The developing apparatus according to claim 1, wherein said carrier is a ferrite carrier.

3. The developing apparatus according to claim 1, wherein said mixing roll provides a component of developer motion across said detection surface, transverse to the tangential direction of said mixing roll.

4. The developing apparatus according to claim 1, wherein said mixing roller comprises a shaft rotatably supported by said containers, and a plurality of blades slantingly secured to said shaft so that said developer is fully mixed and stirred as said shaft rotates.

5. The developing apparatus according to claim 4, wherein said blades are in an oval form so that each point of said blades moves back and forth along said shaft during the rotation, thereby ensuring the full mixing and stirring of said developer.

6. The developing apparatus according to claim 1, wherein said detection device further comprises a smoothing circuit having a time constant $\tau$ satisfying the equation:

$$4/N \geqq \tau \geqq 1/N$$

wherein N represents the number of times a point on the periphery of said mixing roller passes said detection surface in a second.

* * * * *